United States Patent [19]

Otto

[11] 4,113,430

[45] Sep. 12, 1978

[54] METHOD FOR MODIFYING FIBERS OF A FABRIC AND THE PRODUCTS SO PRODUCED

[75] Inventor: Wolfgang K. F. Otto, Spartanburg, S.C.

[73] Assignee: Milliken Research Corporation, Spartanburg, S.C.

[21] Appl. No.: 799,623

[22] Filed: May 23, 1977

Related U.S. Application Data

[63] Continuation-in-part of Ser. No. 729,260, Oct. 4, 1976.

[51] Int. Cl.[2] ..... D06M 9/00; D06M 1/02

[52] U.S. Cl. ..... 8/115.5; 8/114.6; 8/115.6; 8/115.7; 8/116 R; 8/125; 8/167; 8/188

[58] Field of Search ..... 8/115.5, 114.6, 116 R, 8/188, 125, 115.7, 167, 115.6

[56] References Cited

U.S. PATENT DOCUMENTS

| | | | |
|---|---|---|---|
| 1,802,956 | 4/1931 | Platt | 8/167 |
| 1,884,620 | 10/1932 | Dreyfus et al. | 8/167 |
| 2,068,770 | 1/1937 | Schwarzschild | 8/14 |
| 2,292,433 | 8/1943 | Croft | 8/24 |
| 2,344,974 | 3/1944 | Croft et al. | 8/57 |
| 2,539,301 | 1/1951 | Foster | 8/115.5 |
| 2,590,402 | 3/1952 | Hall et al. | 8/115.5 |
| 2,781,242 | 2/1957 | Knapp | 8/115.5 |
| 2,990,231 | 6/1961 | Nusslein et al. | 8/115 |
| 3,083,118 | 3/1963 | Bridgeford | 117/47 |
| 3,135,577 | 6/1964 | Watson et al. | 8/115.5 |
| 3,644,079 | 2/1972 | Smith et al. | 8/4 |
| 3,874,958 | 4/1975 | Scholtis et al. | 8/114.6 |
| 4,008,044 | 2/1977 | Latta et al. | 8/115.5 |

FOREIGN PATENT DOCUMENTS 4,801,397 5/1971 Japan.

*Primary Examiner*—A. Lionel Clingman
*Attorney, Agent, or Firm*—H. William Petry; G. Mike Burdick

[57] ABSTRACT

A method for modifying fibers of a fabric which comprises the steps of applying an effective amount of a heat activated fiber modifying agent to a fabric, heating a portion of the fabric for a period of time effective to initiate a chemical reaction between the fibers of the fabric being heated and the fiber modifying agent while maintaining a temperature differential between the heated portion of the fabric and the remainder of the fabric to thus control the area of penetration of the chemical reaction into the fabric, quenching the chemical reaction, and thereafter recovering the product.

13 Claims, No Drawings

METHOD FOR MODIFYING FIBERS OF A FABRIC AND THE PRODUCTS SO PRODUCED

This application is a continuation-in-part of my copending application, Ser. No. 729,260, filed Oct. 4, 1976.

The present invention relates to a method for modifying the fibers of a fabric. In one aspect, it relates to a method for modifying fibers of a fabric wherein the fiber modification is controlled. In still another aspect the invention relates to the products produced by the modification of fibers of a fabric.

Methods have heretofore been proposed for modifying fibers of fabrics, such as polyester fabrics, so as to improve certain properties of the fabrics or to alter their appearance. Numerous chemical and physical means have been employed to accomplish such fiber modification. For example, a large variety of chemicals, such as depolymerizing agents, have been incorporated into fabrics so that a depolymerization reaction could occur thus altering the fiber characteristics of the fabric. Additionally, methods have been proposed to heat dry fabrics to alter the fiber characteristics of such fabrics. However, when employing the methods proposed by the prior art, problems have been encountered if one attempts to effectively and efficiently confine the area of treatment of a fabric to a predetermined surface, or area, without modifying the fibers of the fabric completely throughout same. Thus, a need has long been recognized for an improved method which would allow one to modify certain fibers within a fabric without affecting other fibers and thereby produce a fabric having desired characteristics or appearance.

An object of the invention is to provide an improved process for modifying fibers of a fabric. Another object of the invention is to provide an improved fabric in which a preselected portion of the fibers of the fabric have been modified. Yet another object of the invention is to provide an improved process for modifying fibers of a fabric wherein the fiber modification is conducted on a specific area and/or to a desired depth of penetration into the fabric while maintaining other fibers in the fabric in their unmodified condition. These and other objects, advantages and features of the invention will be apparent to those skilled in the art from a reading of this disclosure.

Broadly, the present invention relates to improved products and to methods for producing same wherein selected fibers of a fabric are modified without modification of the remaining fibers of the fabric. The controlled modification of selected fibers of the fabric is achieved by applying an effective amount of heat activated fiber modifying agent to the fabric so that the surface of the fibers of the fabric is substantially covered with the heat activated fiber modifying agent. Thereafter, heat is applied to that portion of the fabric in which the fiber modification is desired for a period of time effective to initiate a chemical reaction between the fibers of the fabric being heated and the fiber modifying agent. In obtaining the desired results, it is essential one simultaneously maintain a temperature differential between the heated portion of the chemically treated fabric and the remainder of the fabric so that the chemical reaction between the heat activated fiber modifying agent and the fibers can be readily controlled. Once the desired fiber modification has transpired, the fabric and thus the chemical reaction is quenched to prevent further fiber modification. Thereafter, the resulting product is recovered. It is to be understood, that if desirable, other normal processing steps in the manufacturing process of fabrics can be employed without altering the method of modification of select fibers of a fabric. For example, after the fiber modification has occurred due to the chemical reaction between the fibers being modified and the heat activated fiber modifying agent, and the reaction has been quenched, the fabric can be subjected to other fabric processing steps such as dyeing, napping, steaming, drying and the like.

In a more specific aspect, the fabric is contacted with an effective amount of a liquid admixture containing at least one heat activated fiber modifying agent and thereafter the portion of the fabric containing the fibers to be modified is heated to a temperature of from about 150° F. to about 425° F. for a period of time of from about 0.1 second to about 1 minute. Simultaneously with the heating of the portion of the fabric wet or coated with the heat activated fiber modifying agent the portion of the fabric opposite that portion being heated is cooled to provide a temperature on the opposite portion of from about 70° F. to about 280° F. and thus provide a temperature on such opposite side of the fabric of at least about 50° F., preferably at least about 100° F. cooler than the surface of the fabric to which heat is applied.

The fabrics employed to produce the products of the present invention wherein a portion of the fibers of a fabric are modified by the reaction of a heat activated fiber modifying agent, the application of heat and the simultaneous cooling of other portions of the fabric can be any suitable fabric containing natural and/or synthetic fibers. Examples of suitable fabrics are those containing fibers of polyester, nylon, acetate, Kevlar, wool, cotton, linen, silk, acrylic, and mixtures of such synthetic and natural fibers. Especially desirable results can be obtained when employing the method of the present invention to modify fabrics containing polyester fibers.

Once the fabric has been selected and it is determined that is is desirable to selectively modify certain of the fibers within the fabric to alter the chemical and/or physical properties of the fabric such can readily be accomplished by employing the process of the present invention. In such instance, an effective amount of a heat activated fiber modifying agent is applied to the fabric to substantially cover the surface of the fibers of the fabric. The amount of heat activated fiber modifying agent employed can vary widely, the only requirement being that sufficient modifying agent be employed to substantially cover all of the fibers of the fabric in the area of the fabric where the fiber modification is desired. Preferably, the heat activated fiber modifying agent is applied to the fabric as a liquid admixture containing at least one heat activated fiber modifying agent. The amount of heat activated fiber modifying agent present in the liquid admixture can vary widely but will generally be present in an amount of from about 0.1 to about 25 weight percent. Further, the liquid admixture can contain a single heat activated fiber modifying agent or a combination of such agents.

Any suitable liquid which is substantially inert to the heat activated fiber modifying agent and the fibers of the fabric can be employed as the carrier liquid for the liquid admixture or paste containing the heat activated fiber modifying agent. Generally, the carrier liquid is an organic solvent or water. Typical of organic solvents which can be employed as the liquid carrier for the heat activated fiber modifying agent are non-polar solvents, e.g., the chlorinated hydrocarbon solvents, such as trichloroethylene, carbon tetrachloride, and the like, aromatic solvents, such as benzene, toluene and the like, and polar organic solvents, such as dimethyl sulfoxide, dimethyl formamide, alcohols, such as ethanol, isopropanol, hexanol and the like, ethers such as diethyl ether, dioxane and the like and hydrocarbon solvents such as hexanes, octanes and the like. Preferably, the liquid admixture is an aqueous admixture containing from about 0.1 to about 25 weight percent of at least one heat activated fiber modifying agent. Desirable results can be obtained when the heat activated fiber modifying agent or agents is present in the aqueous admixture in an amount of from about 0.5 to about 15 weight percent.

It is often desirable to formulate the liquid admixtures or pastes containing the heat activated fiber modifying agent so as to provide such admixtures or pastes with sufficient viscosities to prevent uncontrolled migration or wicking of the heat activated fiber modifying agent or agents within or throughout the fabric. Further, it may be desirable to inhibit the mobility of the free-flowing heat activated fiber modifying agent retained in the interstices between fibers and yarns of the treated fabric to thus reduce heat transfer from the heated side or portion of the fabric to the unheated side or portion of the fabric due to flow of the hot liquid admixture. Generally, such can be accomplished by the incorporation of an effective amount of a thickening agent into the carrier liquid of the liquid admixture or paste to provide a resulting liquid admixture or paste having a viscosity of from about 500 cps to about 1,000,000 cps (viscosity as determined by a Brookfield RVF with a No. 6 spindle at 4 rpm when the viscosity is above 3,000 cps and by a Brookfield RVF with a No. 2 spindle at 10 rpm when the viscosity is less than 3,000)cps. Especially desirable results can be obtained when the liquid admixture containing the heat activated fiber modifying agent is an aqueous admixture having a viscosity of from about 500 cps to about 10,000 cps.

When employing a thickening agent to increase the viscosity of the liquid admixture or paste any suitable thickening agent can be employed, such agents being well known in the art, provided the thickening agent selected is compatible with the liquid carrier and is substantially inert to the constituents of the liquid admixture or paste.

Illustrative of thickening agents which can be employed when water is the carrier liquid are the cellulose derived thickening agents, gums, such as guar gum, polysaccarides, polyacrylates, silicates and the like. Thickening agents which can be employed when an organic solvent is used as a carrier liquid are the commercially available thickening agents sold under the trademarks carbopol, cabosil, and the like.

The method of application of the heat activated modifying agent to the fabric can vary widely and any suitable means can be employed such as padding, spraying, coating, dusting, and the like. When employing a liquid admixture, the heat activated modifying agent is preferably applied to the fabric by padding or coating.

The term "heat activated fiber modifying agent" as used herein is to be understood to mean those chemicals which, upon application of heat, readily and quickly react with the fibers of a fabric and thus alter the physical and/or chemical properties of the fibers. Typical of the reactions produced between such heat activated fiber modifying agents and the fibers are depolymerization, functional group substitution, grafting or polymerization, chemical cross-linking and the like. Any suitable heat activated fiber modifying agent can be employed to carry out the method of the present invention. Further, it should be understood that many of the "heat activated fiber modifying agents" which can be employed in the practice of the present invention may have a propensity to slowly react with the fibers of the material being treated at ambient temperatures. However, such compounds when heated, react rapidly with the fibers to produce the desired controlled fiber modification in accordance with the present invention.

As previously stated, any heat activated fiber modifying agent which is capable of reacting with the fibers of a fabric at elevated temperatures can be employed. Generally, such compounds are chemical compounds known in the art as nucleophiles, electrophiles, free radical precursors, free radicals, mixtures of such compounds and the like. Nucleophiles are to be understood to be nucleophilic compounds in which the nucleophilic atom is H—,O,N,S,P or a halogen. Such nucleophilic compounds are generally represented by the formula RAM wherein R is H, an alkyl, aryl, alicyclic, substituted alkyl, substituted aryl and substituted alicyclic moiety, A is a nucleophilic atom as previously defined, and M is a counter cation selected from the group consisting of H, Group IA, IIA, and IIIA of the Periodic Table, transition metals, quaternary ammonium or quaternary phosphonium compounds. The alkyl moiety of R can be a saturated, unsaturated, branched or straight chain alkyl moiety and can be mono - or poly - substituted at any position by O, N, S, P, a halogen, or an organic moiety such as aryl, substituted aryl, alicyclic, substituted alicyclic, heterocyclic and substituted heterocyclic moieties.

Electrophiles are electron deficient species, such as Lewis acids, alkylating agents and the like which are capable of reacting with the fibers of the fabric being treated. The Lewis acids which can be employed in the practice of the invention can be generated from the following precursors:

$HNO_3—H_2SO_4$ $HNO_2$ $R{=}\overset{\overset{\displaystyle O}{\|}}{C}—X + AlCl_3$ $(R—\overset{\overset{\displaystyle O}{\|}}{C})_2—O$ $R—X + AlCl_3$ $CH_3—O—\overset{\overset{\displaystyle O}{|}}{\underset{\underset{\displaystyle O}{|}}{S}}—O—CH_3$ $CH_3—O—\overset{\overset{\displaystyle O}{|}}{\underset{\underset{\displaystyle O}{|}}{S}}—F$ and the like wherein R is H, an alkyl, aryl, alicyclic, substituted alkyl, substituted aryl, and substituted alicyclic moiety and X is a halogen, such as Cl, Br, F and I.

Likewise, any suitable free radical precursor or free radical can be employed as the heat activated fiber modifying agent in the method of the invention provided such free radical precursor or free radical is capable of reacting with the fibers of the fabric under the specified conditions. Typical of such free radical precursors and free radicals are azo bis(isobutyronitrile), di-tert-butylperoxide, benzoyl peroxide, metals of group IA, IIA and IIIA of the Periodic Table and odd electron species, such as napthalene radical anion, galvanoxyl, diphenylpicrylhydrazil and Fremi's salt.

As previously stated, the heat activated fiber modifying agent employed in the process of the present invention can be applied to the fabric in any suitable form, such as a solid, a paste, a liquid admixture, and the like. Further, such agent can be applied to the whole fabric, to portions of the fabric, or to only one side of the fabric. The particular application of the heat activated fiber modifying agent to the fabric will depend to a large extent upon the final product desired.

Once the desired amount of heat activated fiber modifying agent has been applied to the fibers of the fabric being treated, the fabric is heated at an elevated temperature for an effective period of time to initiate the desired chemical reaction between the fiber modifying agent and the fibers in that portion of the fabric wherein fiber modification is desired. The temperature at which the portion of the fabric to be modified is heated can vary widely, but should be maintained below the melting point of the fibers. Generally, the fibers covered or wetted with a heat activated fiber modifying agent are heated to a temperature of from about 150° F. to 425° F. for a period of time effective to allow the desired reaction to take place. The time required for the heating of the fibers of the fabric being treated can also vary widely and will depend to a large extent upon the amount of fiber modification desired as well as the response of the treated fabric to the heat source. However, generally the heating period is within a time period of from about 0.1 second to about 1 minute, preferably from about 0.5 to about 20 seconds.

Any suitable heating means can be employed as the heat source to initiate the reaction between the fibers of the fabric and the heat initiated fiber modifying agent. For example, convection heating means, radiant heating means, and open flame can be employed to heat the heat activated fiber modifying agent and the fibers of the fabric to the desired temperature to allow the fiber modification to occur. Especially desirable results have been obtained when an open flame or a contact heating means, such as a heated can, is employed as the heat source because the open flame or the heated can more rapidly heats the fibers of the textile and the heat activated fiber modifying agent to the desired reaction temperature.

Simultaneously with the heating of the fibers of the fabric and the heat activated fiber modifying agent it is necessary that one maintain a temperature differential between the heated surface and the remainder of the fabric to control the amount of fiber modification and to restrict the area of fiber modification within the fabric. Generally, a sufficient temperature differential is provided if the remainder of the fabric, e.g., the unheated portion of the fabric, is maintained at a temperature of from about 70° F. to about 280° F. so as to provide a temperature differential of at least 50° F., preferably at least about 100° F. cooler than the temperature of the fibers of the portion of the fabric being heated. When it is determined that it is necessary to cool the remaining portion of the fabric in order to control the fiber modification in a desired area or to a desired depth any suitable means can be employed to cool the remaining portion of the fabric. For example, cool air can be blown across the remaining portion of the fabric to facilitate the maintaining of the temperature of the other portion of the fabric at less than about 280° F. Further, cooling rollers can be employed to contact the unheated portion of the fabric to insure that the required temperature different of at least about 50° F., preferably at least about 100° F., is maintained between the area of the fabric being heated and that area not being subjected to the heating process. If one desires to modify the fibers on only one side of a fabric, heat is applied to that side of the fabric while maintaining the desired temperature differential between the heated side of the fabric and the unheated side of the fabric. Likewise, if one desires to produce a fabric having modified fibers on each surface of the fabric while maintaining an unmodified core portion within the fabric, such can be readily accomplished by heating one side of the fabric treated with the heat activated fiber modifying agent for a period of time to allow the chemical reaction to occur, while maintaining a temperature differential throughout the remainder of the fabric. Thereafter, the unheated side portion of the fabric can be subjected to heat while providing a temperature differential throughout the fabric by cooling the previously heated side portion. However, when employing such a sequential step, one must carefully determine the amount of cooling required to allow fiber modification on the surface of the fabric while providing a sufficient temperature differential throughout the fabric to insure that the core of the fabric will be substantially unmodified.

After the desired fiber modification has occurred due to the combination of the heat activated fiber modifying agent, the heat, and the simultaneous cooling of that portion of the fabric which is to be unmodified, the resulting modified fabric is quenched to prevent further fiber modification by the heat activated fiber modifying agent. Any suitable quenching process can be employed. However, especially desirable results can be obtained when the modified fabric is quenched with water or an aqueous neutralizing solution to remove and/or inactivate the remaining heat activated fiber modifying agent. After quenching, the modified fabric can be washed, dried or subjected to other textile or fabric processing conditions such as steaming, dyeing, napping and the like.

It should be noted that while any of the before-mentioned heating means can be used as the heat source to initiate the reaction between the fibers of the fabric to be modified and the heat activated fiber modifying agent, care should be exercised to insure uniform heat application to the total side or surface of the fabric containing fibers wet with the heat activated fiber modifying agent. Thus, it may be desireable to place the fabric under tension to insure a substantially smooth uniform surface on the fabric during application of heat.

In order to illustrate further the details of the method of this invention, the following specific examples are given. These examples are presented primarily for the purpose of illustration and any enumeration or details contained therein are not to be interpreted as a limitation on the invention except as indicated in the appended claims. All weights referred to in these examples are parts by weight unless otherwise indicated.

EXAMPLE I

A series of experiments were conducted to determine the effectiveness of certain heat activated fiber modifying agents on a texturixed polyester double knit fabric.

In each experiment the fabric sample, a textured polyester double knit fabric, unless otherwise indicated, was dipped into an aqueous solution containing a specified amount of the heat activated fiber modifying agent and then the excess solution was removed from the fabric sample by nipping the wetted fabric sample at 60 psi. Each damp fabric sample was then placed on a hot plate which had previously been heated to a specified temperature and the fabric was maintained thereof for varying periods of time. Care was exercised to ensure complete contact between one surface of the fabric and the hot plate. The heat treated fabric sample was then removed and immediately quenched by washing with an aqueous acetic acid solution (a) except as where otherwise noted. After washing, the fabric was dried, sanded and examined as to appearance of the nap in order to determine the effectiveness of the treatment. Thereafter, the fabric was tested, using burst strength measurements to determine the control of the fiber modification. The difference between the burst strength measurements of treated and untreated fabric, e.g., percent of burst strength lost of the treated fabric is indicative of the control of the fiber modification of a fabric using the process of the invention. It should be understood that substantial strength loss on the treated surface is preferable while preventing substantial overall strength loss of the total fabric.

TABLE I

| Heat Activated Fiber Modifying Agent | | Temp. F. (Approx.) | Contact Time (Sec.) | Burst Strength (b) After Treatment/ Before Treatment | % Burst Strength Lost |
|---|---|---|---|---|---|
| Agent | % | | | | |
| $H_2SO_4$ | 5(c) | 350 | 4 | 282/296 | −4.7 |
| NaOH | 20 | 350 | 5 | 281/300 | −6.3 |
| NaOH | 20 | 350 | 15 | 279/300 | −7.0 |
| NaOH | 20 | 350 | 30 | 238/300 (Ave. - 2 experiments) | −20.7 |
| NaOH | 20 | 350 | 45 | 76/300 | −74.7 |
| NaOH | 20 | 350 | 60 | Rotted | |
| NaOH | 20 | 375 | 30 | 203/300 | −32.3 |
| NaOH | 20 | 400 | 30 | 88/300 | −70.7 |
| NaOH | 20 | 375 | 15 | 273/300 | −9.0 |
| NaOH | 20 ) | 375 | 15 | 161/300 | −46.3 |
| B-100 | 2(d) ) | | | | |
| NaOH | 20 ) | 375 | 15 | 97/300 | −67.7 |
| C-50 | 2(e) ) | | | | |
| NaOH | 20 ) | 375 | 15 | 187/300 | −37.7 |
| 12-50 | 2(f) ) | | | | |
| NaOH | 10 | 375 | 15 | 283/300 | −5.7 |
| NaOH | 10 ) | 375 | 15 | 218/300 | −27.3 |
| B-100 | 2(d) ) | | | | |
| NaOH | 10 ) | 375 | 15 | 204/300 | −32.0 |
| 12-50 | 2(f) ) | | | | |
| NaOH | 10 | 375 | 15 | 246/300 (Ave. - 2 experiments | −18.0 |
| NaOH | 10 ) | | 10 | 266/300 | −11.3 |
| C-50 | 2(e) ) | | 5 | 277/300 | −7.7 |
| NaOH | 10 ) | 375 | 15 | 239/300 | −20.3 |
| C-50 | 1(e) ) | | | | |
| NaOH | 10 ) | 375 | 15 | 251/300 | −16.3 |
| 12-50 | 2(f) ) | | 10 | 271/300 | −9.7 |
| | | | 5 | 278/300 | −7.3 |
| NaOH | 10 ) | 375 | 15 | 223/300 | −25.7 |
| 12-50 | 1(f) ) | | | | |
| NaOH | 5 | 375 | 15 | 281/300 | −6.3 |
| NaOH | 5 ) | 375 | 15 | 260/300 | −13.3 |
| C-50 | 2(e) ) | | | | |
| NaOH | 5 ) | 375 | 15 | 265/300 | −11.7 |
| C-50 | 1(e) ) | | | | |
| NaOH | 5 ) | 375 | 15 | 275/300 | −8.3 |
| 12-50 | 2(f) ) | | | | |
| NaOH | 5 ) | 375 | 15 | 278/300 | −7.3 |
| 12-50 | 1(f) ) | | | | |
| NaOH | 10 ) | 375 | 2 | 304/306 | −0.7 |
| C-50 | 2(e) ) | | 4 | 303/306 | −1.0 |
| | | | 8 | 277/306(g) | −9.5 |
| | | | 12 | 274/306 | −10.5 |
| | | | 15 | 233/306 | −23.9 |
| NaOH | 10 ) | 400 | 2 | 315/306 | 2.9 |
| C-50 | 2(e) ) | | 4 | 300/306 | −2.0 |
| | | | 8 | 280/306(h) | −8.5 |
| NaOH | 5 ) | 375 | 2 | 299/306 | −2.3 |
| C-50 | 2(e) ) | | 4 | 296/306 | −3.3 |
| | | | 8 | 293/306(i) | −4.3 |
| | | | 12 | 289/306 | −5.6 |
| | | | 15 | 276/306 | −9.8 |
| NaOH | 5 ) | 400 | 2 | 310/306 | 1.3 |
| C-50 | 2(e) ) | | 4 | 306/306 | 0.0 |
| | | | 8 | 289/306(j) | −5.6 |
| NaOH | 5 ) | 380 | 4 | 279/327 | −14.7 |
| C-50 | 2(e) ) | 380 | 8 | 273/327 | −16.5 |
| NaOH | 5 ) | 380 | 4 | 290/331 | −12.4 |
| C-50 | 2(e) ) | 380 | 8 | 269/331 | −18.7 |
| NaOH | 5 ) | 380 | 4 | 242/277 | −12.6 |
| C-50 | 2(e) ) | 380 | 8 | 235/277 | −15.2 |
| NaOH | 5 ) | 380 | 4 | 361/362(k) | −0.3 |
| C-50 | 2(e) ) | | 8 | 360/362 | −0.6 |
| NaOH | 5 ) | 380 | 4 | 355/365(k) | −2.7 |
| C-50 | 2(e) ) | 380 | 8 | 349/365(k) | −4.4 |
| NaOH | 5 ) | 380 | 4 | 257/295 | −12.9 |

TABLE I-continued

| Heat Activated Fiber Modifying Agent | | Temp. F. (Approx.) | Contact Time (Sec.) | Burst Strength (b) After Treatment/ Before Treatment | % Burst Strength Lost |
|---|---|---|---|---|---|
| C-50 | 2(e) ) | 380 | 8 | 258/295 | −12.5 |
| NaOH | 5 ) | 380 | 4 | 246/295 | −16.6 |
| C-50 | 2(e) e) | 380 | 8 | 239/295 | −19.0 |
| NaOH | 20 | 375 | 15 | (1) | |

Footnotes for Table I:

(a)Quenching solution maintained at a pH below 5 by addition of acetic acid.

(b)Mullen burst strengths. First number is the value for a face treated fabric, and second number is value for an identical untreated fabric. This measurement is made by holding fabric over a rubber diaphragm and measuring the pressure at burst in p.s.i.

(c)Water quenched (d)B-100 is Arquad B-100 manufactured by Armak Chemicals Division (quaternary ammonium salt)

(e)C-50 is Arquad C-50 manufactured by Armak Chemicals Division (quaternary ammonium salt)

(f)12-50 is Arquad 12-50 manufactured by Armak Chemicals Division (g)Deknitting of the treated fabrics showed that the treatment was preferential for one side. A number of yarns from the face and back were removed and their breaking strength in grams determined on an Instron apparatus. The average values of such yarns were then compared to yarns taken from an identical but untreated fabric. Treated/Untreated Face-373/600 Back-494/550

(h)Deknitting of the treated fabrics showed that the treatment was preferential for one side. A number of yarns from the face and back were removed and their breaking strength in grams determined on an Instron apparatus. The average values of such yarns were then compared to yarns taken from an identical but untreated fabric. Treated/Untreated Face-417/600 Back-500/550

(i)Deknitting of the treated fabrics showed that the treatment was preferential for one side. A number of yarns from the face and back were removed and their breaking strength in grams determined on an Instron apparatus. The average values of such yarns were then compared to yarns taken from an identical but untreated fabric. Treated/Untreated Face-423/600 Back-492/550

(j)Deknitting of the treated fabrics showed that the treatment was preferential for one side. A number of yarns from the face and back were removed and their breaking strength in grams determined on an Instron apparatus. The average values of such yarns were then compared to yarns taken from an identical but untreated fabric. Treated/Untreated Face-349/600 Back-501/550

(k)Polyester Woven Fabric (l)A Dacron D56T thread was sewn into the face and one into the back.

The face thread was rotted after treatment while the back thread retained 95% of its strength.

The above date clearly indicates one can readily control the area or depth of penetration of the fiber modification of a fabric using the method of the invention.

EXAMPLE II

A series of experiments were conducted to determine the effectiveness of certain heat activated fiber modifying agents on samples of texturized polyester double knit fabrics except where otherwise indicated. The same general procedure as set forth in Example I was employed except that when the wetted fabric was contacted with the hot plate, a pan containing ice water was placed on the backside of the fabric to further cool the backside of the fabric and to thus provide a greater temperature differential between the surface of the fabric in contact with the hot plate and the backside of the fabric. Table II summarizes the results of such experiments.

TABLE II

| Heat Activated Fiber Modifying Agent | | Temp. F. (Approx.) | Contact Time (Sec.) | Burst Strength (b) After Treatment/ Before Treatment | % Burst Strength Lost |
|---|---|---|---|---|---|
| Agent | % | | | | |
| NaOH | 20 | 375 | 15 | 272/300 | −9.3 |
| | | | 30 | 276/300 | −8.0 |
| NaOH | 20 | 375 | 30 | 288/301(b) | −4.3 |
| | | | 30 | 287/301(b) | −4.7 |
| | | | 30 | 212/301(c) | −29.6 |
| | | | 30 | 254/301(d) | −15.6 |
| NAOH | 20 | 375 | 30 | 308/362(b) | −14.9 |
| | | | 30 | 152/362 | −58.0 |
| NaOH | 20 | 375 | 30 | 275/305(b) | −9.8 |
| | | | | 103/305 | −66.2 |
| NaOH | 20 | 375 | 30 | 272/311(b) | −12.5 |
| | | | | 163/311 | −47.6 |
| NaOH | 20 | 375 | 30 | 277/320(b) | −13.4 |
| | | | | 157/320 | −50.9 |
| NaOH | 20 | 375 | 30 | 247/269(b) | −8.2 |
| | | | | 221/269 | −17.8 |
| NaOH | 20 | 375 | 30 | 310/300(b) | 3.3 |
| | | | | 281/300 | −6.3 |
| NaOH | 20 | 375 | 30 | 221/267(b) | −17.2 |
| | | | | 216/267 | −19.1 |
| NaOH | 20 | 375 | 30 | 227/234(b) | −3.0 |
| | | | | 221/234 | −5.6 |
| NaOH | 5 ) | 380 | 8 | 285/327 | −12.8 |
| C-50 | 2(e) ) | | 12 | 287/307 | −6.5 |
| | | | 16 | 283/300 | −5.7 |
| | | | 8 | 281/331 | −15.1 |
| | | | 12 | 288/317 | −9.2 |
| | | | 16 | 284/322 | −11.8 |
| | | | 8 | 236/277 | −14.8 |
| | | | 12 | 255/262 | −2.7 |
| | | | 16 | 246/257 | −4.3 |
| | | | 8 | 358/362(a) | −1.1 |
| | | | 12 | 367/373 | −1.6 |
| | | | 16 | 363/370 | −1.9 |
| | | | 8 | 357/365(a) | −2.2 |
| | | | 8 | 257/295 | −12.9 |

TABLE II-continued

| Heat Activated Fiber Modifying Agent | Temp. F. (Approx.) | Contact Time (Sec.) | Burst Strength (b) After Treatment/ Before Treatment | % Burst Strength Lost |
|---|---|---|---|---|
| | | 12 | 261/291 | −10.3 |
| | | 16 | 276/293 | −5.8 |
| | | 8 | 246/295 | −16.6 |
| | | 12 | 258/263 | −1.9 |
| | | 16 | 240/262 | −8.4 |

Footnotes for Table II:
(a)Woven polyester
(b)In each case, one side of the fabric was treated and tested. The first value is for the smoother side.
(c)Both sides treated, smoother side up for burst test.
(d)Both sides treated, rougher side up for burst test.
(e)C-50 is Arquad C-50 manufactured by Armak Chemicals Division (quaternary ammonium salt)

The burst strength of samples prepared by the process described in Example II was tested and compared with the burst strength of untreated samples of identical fabrics. The effectiveness of the treatment on the treated fabric side was evaluated by reviewing stereoscan micrographs, by staining with the solution of a basic dyestuff, and by sanding of the surface and evaluation of the raised nap.

The samples processed by the method described in Example II, when compared with samples processed by the method described in Example I, showed an improved retention of overall fabric strength at equivalent or greater treatment effect on the treated side of the fabric.

EXAMPLE III

Experiments were conducted to determine the effectiveness of an aqueous solution of sodium hydroxide as the heat activated fiber modifying agent and an open gas flame as the heat generating source. The same general procedure set forth in Example I was used except that the damp fabric was passed across the open gas flame at a sufficient rate to provide the desired contact time rather than placement of the damp fabric on a hot plate. After contact with the open flame the fabric was quenched with an aqueous acetic acid solution to neutralize the sodium hydroxide. Table III summarizes the results of such experiments.

TABLE III

| Heat Activated Fiber Modifying Agent | | Contact Time (Sec.) | Burst Strength After Treatment/ Before Treatment | % Burst Strength Lost |
|---|---|---|---|---|
| Agent | % | | | |
| NaOH | 20 | 5 | 278/300 | −7.3 |
| | | 15 | 129/300 | −57.0 |

The first experiment reported above clearly illustrates the method of modifying selected fibers of a fabric without a substantial loss in strength of the total fabric. However, if too severe modification of the fibers is allowed to transpire, either due to excess heat or treatment time, serious strength loss of the fabric occurs, as indicated by the data of the second experiment.

EXAMPLE IV

A series of experiments was conducted in which full width (60 inches) fabrics were padded with an aqueous solution containing various heat activated fiber modifying agents. Excess liquid was removed from each padded fabric by nipping the wetted fabrics at 60 psi. The damp fabric was then moved over an oil heated drum, under tension, at a predetermined rate to provide the desired contact time between the heated drum and the wetted fabric. Thereafter, the fabric was quenched, rinsed and dried. Table IV summarizes the results of such experiments.

TABLE IV

| Heat Activated Fiber Modifying Agent | | Temp. F. (Approx.) | Contact Time (Sec.) | Burst Strength (b) After Treatment/ Before Treatment | % Burst Strength Lost |
|---|---|---|---|---|---|
| Agent | % | | | | |
| NaOH | 10 ) | 360 | 15 | 260/276 | −5.8 |
| C-50 | 2 ) | 360 | 15 | 217/325 | −33.2 |
| NaOH | 10 ) | 360 | 15 | 162/259 | −37.5 |
| C-50 | 2(c) ) | | | | |
| | | 360 | 15 | 208/297 | −30.0 |
| | | 380 | 15 | 161/323 | −50.2 |
| | | | 15 | 165/311 | −47.0 |
| | | | 15 | 184/315 | −41.6 |
| | | | 15 | 204/315 | −35.2 |
| | | | 12 | 156/319 | −51.1 |
| NaOH | 5 ) | 390 | 8 | 268/306 | −12.4 |
| C-50 | 2(c) ) | | | | |
| | | | 8 | 269/306 | −12.1 |
| | | 390 | 8.5 | 265/291 | −8.9 |
| | | 395 | 8 | 272/297 | −8.4 |
| | | 380 | 8 | 205/256(a) | −19.9 |
| | | 380 | 8 | 242/281(a) | −13.9 |
| | | 380 | 8 | 253/283(a) | −10.6 |
| | | 380 | | 268/291(a) | −7.9 |
| | | 380 | | 274/297(a) | −7.7 |

Footnotes for Table IV.
(a) Scanning Electron Microscope examination of the treated fabrics clearly showed that the treated side was degraded while the non-treated side was almost completely unchanged.
(b) These fabrics napped before treatment.
(c) C-50 is Arquad C-50 manufactured by Armak Chemicals Divison (quaternary ammonium salt)

The data of Table IV further illustrates the method of modifying selected fibers of a fabric to render the fabric more susceptible to further processing, such as napping, sanding and the like without a substantial loss of fabric strength.

Mullen burst strength measurements were made to determine fabric strength. First number is the value for a face treated fabric, and second number is value for an identical untreated fabric. This measurement is made by holding fabric over a rubber diaphragm and measuring the pressure at burst in psi.

Sample 1: 268/291

Sample 2: 297/275

Deknitting of the treated fabrics showed that the treatment was preferential for one side. A number of yarns from the face and back were removed and their breaking strength in grams determined on an Instron apparatus. The average values of such yarns were then compared to yarns taken from an identical but untreated fabric.

| | | |
|---|---|---|
| Sample 1: | Face-612/161* | Back-600/418 |
| Sample 2: | Face-592/161* | Back-604/401 |

*Average of two measurements.

Further, the modification of the fibers of a fabric in accordance with the concept of the invention results in a product having improved resistance to pilling. Such pilling resistance occurs regardless of whether the napping of the fabric is performed prior to or subsequent to the treatment of the fibers of the fabrics.

The above examples clearly illustrate the concept of the present invention. However, it should be noted that when the heat activated fiber modifying agent is a combination of two or more constituents, such as sodium hydroxide and a quaternary ammonium salt, the amount of each constituent can vary widely. In such a system desirable results can be obtained when the sodium hydroxide is present in an amount of from about 1 to 12 weight percent and the quaternary ammonium salt is present in an amount of from about 0.05 to about 3 weight percent.

Having thus described the invention, I claim:

1. A method for modifying fibers in the stratum of fibers at one surface of a fabric comprising:

(a) applying an effective amount of a heat activated fiber modifying agent to a fabric to substantially cover a surface of the fibers of the fabric;

(b) heating the surface of the fabric containing the stratum of fibers to be modified to a temperature of from about 150° F. to about 425° F. for a period of time effective to initiate a chemical reaction between the fibers of the fabric within the stratum of fibers at the surface of the fabric being heated and said heat activated fiber modifying agent and thereby modify such fibers within the stratum;

(c) simultaneously maintaining a temperature differential between the heated surface of the fabric and the opposite surface of the fabric of at least about 50° F. so as to control the depth of penetration of the chemical reaction and limit the fiber modification of the fibers to substantially the stratum of fibers at the surface of the fabric being heated;

(d) quenching the chemical reaction; and (e) recovering a resulting product.

2. The method of claim 1 wherein said opposite surface of the fabric is maintained at a temperature of at least about 100° F. lower than the temperature of the heated surface of the fabric.

3. The method of claim 2 wherein said time period effective to initiate the chemical reaction is from about 0.1 second to about 1 minute.

4. The method of claim 2 wherein said heat activated fiber modifying agent is applied to only one surface of the fabric.

5. The method of claim 2 which includes the steps of sequentially heating the surface of the fabric opposite the surface previously heated for a period of time effective to initiate a chemical reaction between the fibers in the stratum of fibers at the surface of the fabric being heated and said heat activated fiber modifying agent while simultaneously maintaining a temperature differential between the heated surface of the fabric and the previously heated surface of the fabric to provide an unmodified fiber core portion within the fabric.

6. A method for modifying fibers in the stratum of fibers at one surface of a fabric comprising:

(a) applying a liquid admixture containing an effective amount of at least one heat activated fiber modifying agent to a fabric to provide a wetted fabric and cover the surface of the fibers of said fabric with said heat activated fiber modifying agent;

(b) heating the surface of the wetted fabric containing the stratum of fibers to be modified for a period of time effective to initiate a chemical reaction between said heat activated fiber modifying agent and the fibers within the stratum of fibers at the surface of said wetted fabric at the surface being heated;

(c) simultaneously maintaining a temperature differential between the heated surface of the fabric and the opposite surface of the fabric of at least about 50° F. so as to control the depth of penetration of the chemical reaction and thereby limit the fiber modification of the fibers to substantially the stratum of fibers at the surface of the fabric being heated;

(d) quenching the chemical reaction; and (e) recovering a resulting product.

7. The method of claim 6 wherein said heat activated fiber modifying agent is present in said liquid admixture in an amount of from about 0.1 to about 25 weight percent.

8. The method of claim 7 wherein said opposite surface of said fabric is maintained at a temperature of at least about 100° F. lower than the temperature of the heated surface of the fabric.

9. The method of claim 7 wherein said liquid admixture is an aqueous admixture.

10. The method of claim 9 wherein said time period effective to initiate the chemical reaction is from about 0.1 second to about 1 minute.

11. The method of claim 10 wherein said aqueous admixture is applied to only one surface of the fabric.

12. The method of claim 10 wherein said heat activated fiber modifying agent is present in said aqueous admixture in an amount of from about 0.5 to about 15 weight percent.

13. The method of claim 10 wherein said heat activated fiber modifying agent comprises from about 1 to about 12 weight percent sodium hydroxide and from about 0.05 to about 3 weight percent of a quaternary ammonium salt.

* * * * *